US006250884B1

(12) United States Patent
Huang

(10) Patent No.: US 6,250,884 B1
(45) Date of Patent: Jun. 26, 2001

(54) CEILING FAN

(76) Inventor: Ming-Chien Huang, No. 788, Chung-Shan Rd., Shen-Kang, Hsiang, Taichung Hsien (TW)

( * ) Notice: Subject to any disclaimer, the term of this patent is extended or adjusted under 35 U.S.C. 154(b) by 0 days.

(21) Appl. No.: 09/439,472

(22) Filed: Nov. 15, 1999

(51) Int. Cl.[7] ..... F04D 29/36
(52) U.S. Cl. ..... 416/207; 416/210 R; 416/244 R
(58) Field of Search ..... 416/204 R, 204 A, 416/205, 206, 207, 210 R, 244 R

(56) References Cited

U.S. PATENT DOCUMENTS 5,873,701 * 2/1999 Shiu ..... 416/205

* cited by examiner

*Primary Examiner*—Edward K. Look
*Assistant Examiner*—James M. McAleenan

(74) *Attorney, Agent, or Firm*—Rodman & Rodman

(57) ABSTRACT

A ceiling fan includes a motor having a stator and an annular rotor surrounding concentrically and radially spaced apart from the stator. An upper cover includes an upper major wall mounted on an upper end portion of the stator, and an annular skirt portion spaced radially apart from and shielding an upper part of the rotor to form an annular first peripheral edge. A casing body includes an annular rotor connecting portion secured threadedly on a lower end portion of the rotor, an annular shielding portion extending outwardly and upwardly from the rotor connecting portion towards the first peripheral edge so as to be spaced radially apart from and shield a lower part of the rotor to form an annular second peripheral edge proximate to and spaced apart from the first peripheral edge. A plurality of blade connecting members are angularly spaced from each other, and extend radially and outwardly from the shielding portion such that a plurality of fan blades are secured threadedly on the blade connecting members, respectively.

5 Claims, 5 Drawing Sheets

CEILING FAN

BACKGROUND OF THE INVENTION

1. Field of the Invention

This invention relates to a ceiling fan, more particularly to a ceiling fan with a casing body for shielding a motor and engaging a plurality of fan blades.

2. Description of the Related Art

Referring to FIG. 1, a conventional ceiling fan 1 is shown to include a motor 10, and a motor casing 20 including upper and lower casing halves 22,23 which are interconnected by a connecting member 21. The upper casing half 22 has a central hole 221 for passage of a connecting shaft 11 of the motor 10. The lower casing half 23 has an opening 231 for passage of a bottom portion of a motor 10 such that a plurality of blade connecting arms 30 are secured threadedly on the bottom portion of the motor 10.

The assembly process for the conventional ceiling fan 1 is relatively complicated because it includes threaded engaging operations between the lower casing half 23 and the connecting member 21, between the upper casing half 22 and the connecting member 21, between the upper casing half 22 and the connecting shaft 11, between the blade connecting arms 30 and the motor 10, and between fan blades 31 and the blade connecting arms 30.

SUMMARY OF THE INVENTION

The object of the present invention is to provide a ceiling fan which has a simple construction that is easy to assemble.

According to this invention, the ceiling fan includes a motor having a stator with first upper and lower end portions opposite to each other in an upright direction, and a rotor with annular second upper and lower end portions surrounding concentrically and radially spaced apart from the first upper and lower end portions of the stator respectively and rotatable about an axis parallel to the upright direction, and a lateral circumferential portion disposed between the second upper and lower end portions. An upper cover includes an upper major wall which is mounted on the first upper end portion, and an annular skirt portion which extends downwardly from a periphery of the upper major wall. The annular skirt portion is spaced radially apart from and shields an upper part of the lateral circumferential portion to form an annular first peripheral edge. A casing body includes an annular rotor connecting portion secured threadedly on the second lower end portion of the rotor, and an annular shielding portion extending outwardly and upwardly from the rotor connecting portion towards the first peripheral edge. The annular shielding portion is spaced radially apart from and shields a lower part of the lateral circumferential portion to form an annular second peripheral edge proximate to and spaced apart from the first peripheral edge. A plurality of blade connecting members are angularly spaced from each other, and extend radially and outwardly from the shielding portion such that a plurality of fan blades are secured threadedly on the blade connecting members, respectively.

Preferably, the rotor connecting portion includes a plurality of rotor connecting arms, and the shielding portion includes a plurality of shielding walls. Each rotor connecting arm is formed integrally with one of the shielding walls and one of the blade connecting members.

Preferably, the ceiling fan further includes a lamp seat which has a major wall secured threadedly on the first lower end portion of the stator, and an annular surrounding wall extending downwardly from a periphery of the major wall. A lampshade includes a bowl-shaped bottom portion which has an annular engaging flange disposed around the axis and engaging the annular surrounding wall of the lamp seat for receiving a lamp.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
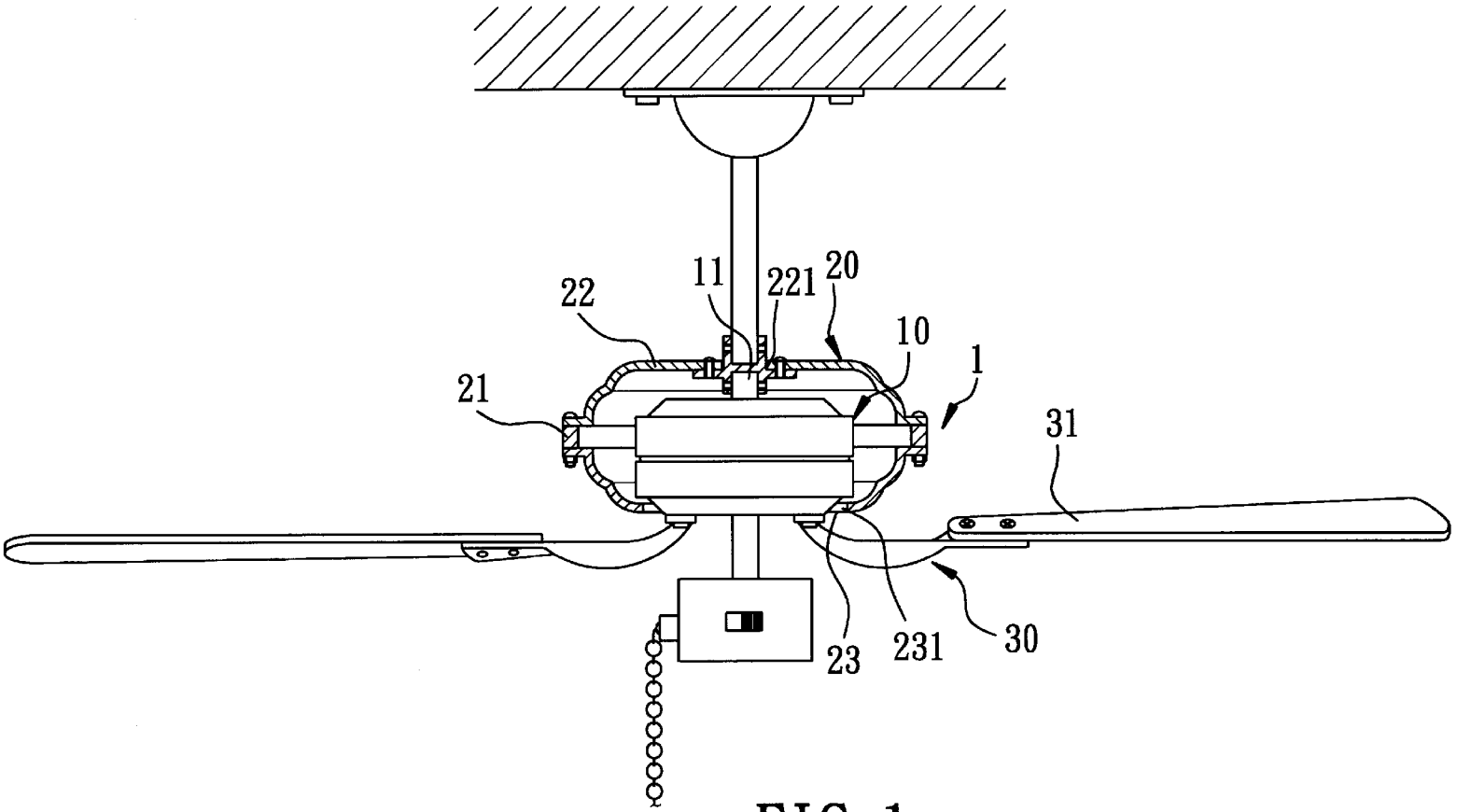
FIG. 1 PRIOR ART
FIG. 1 is a schematic view of a conventional ceiling fan.
Figure 2:
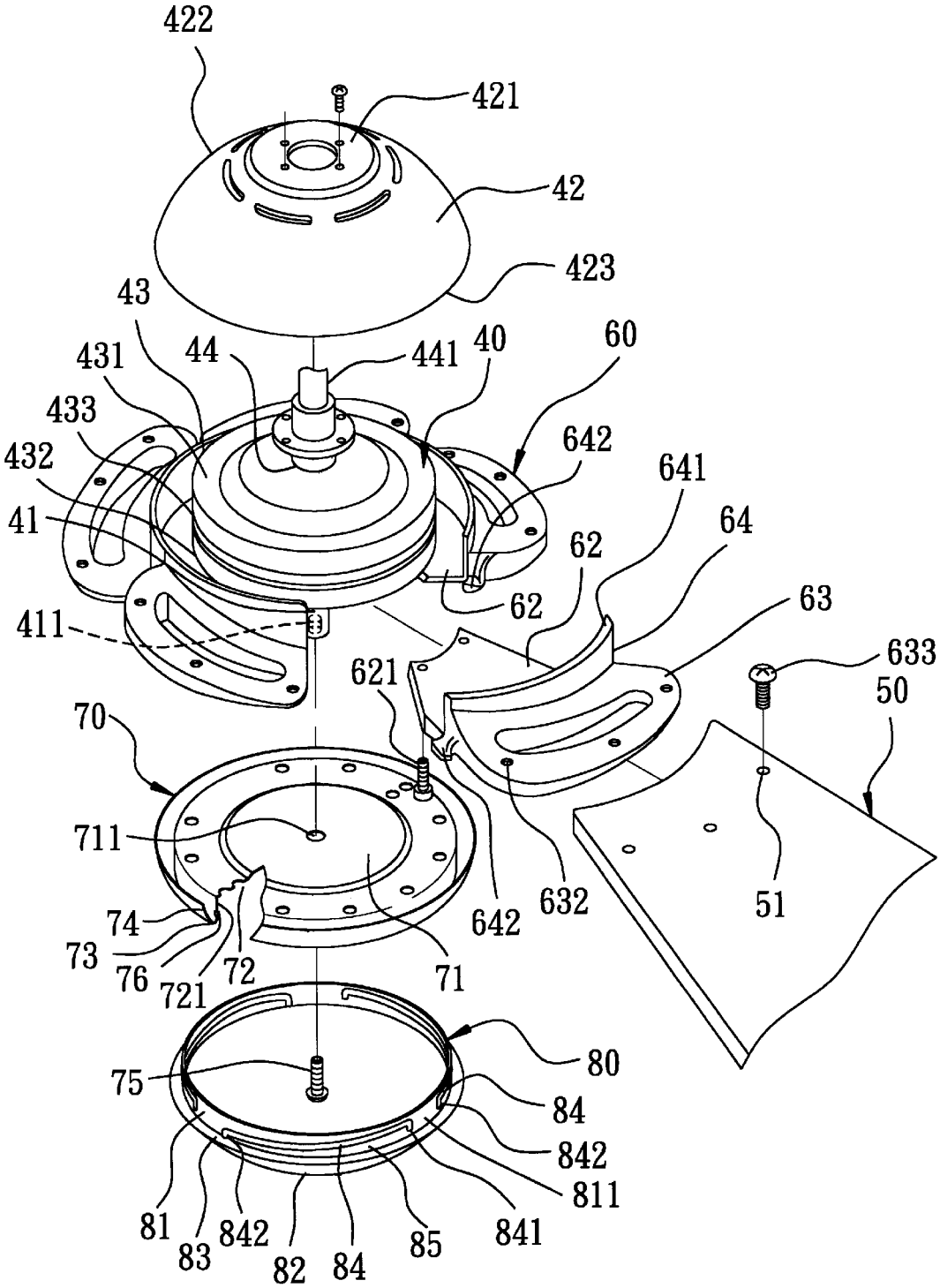
FIG. 2 is a fragmentary exploded view of a preferred embodiment of a ceiling fan according to this invention.
Figure 3:
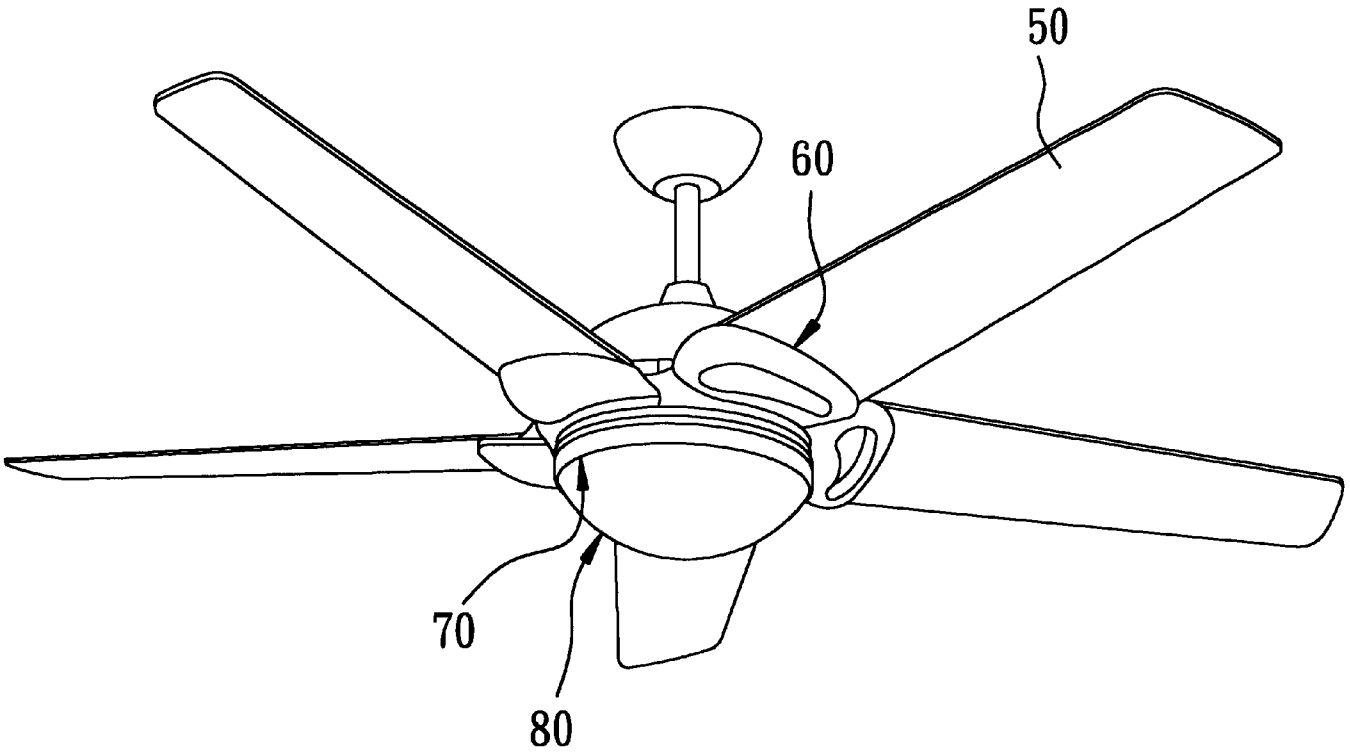
FIG. 3 is a perspective view of the preferred embodiment.
Figure 4:
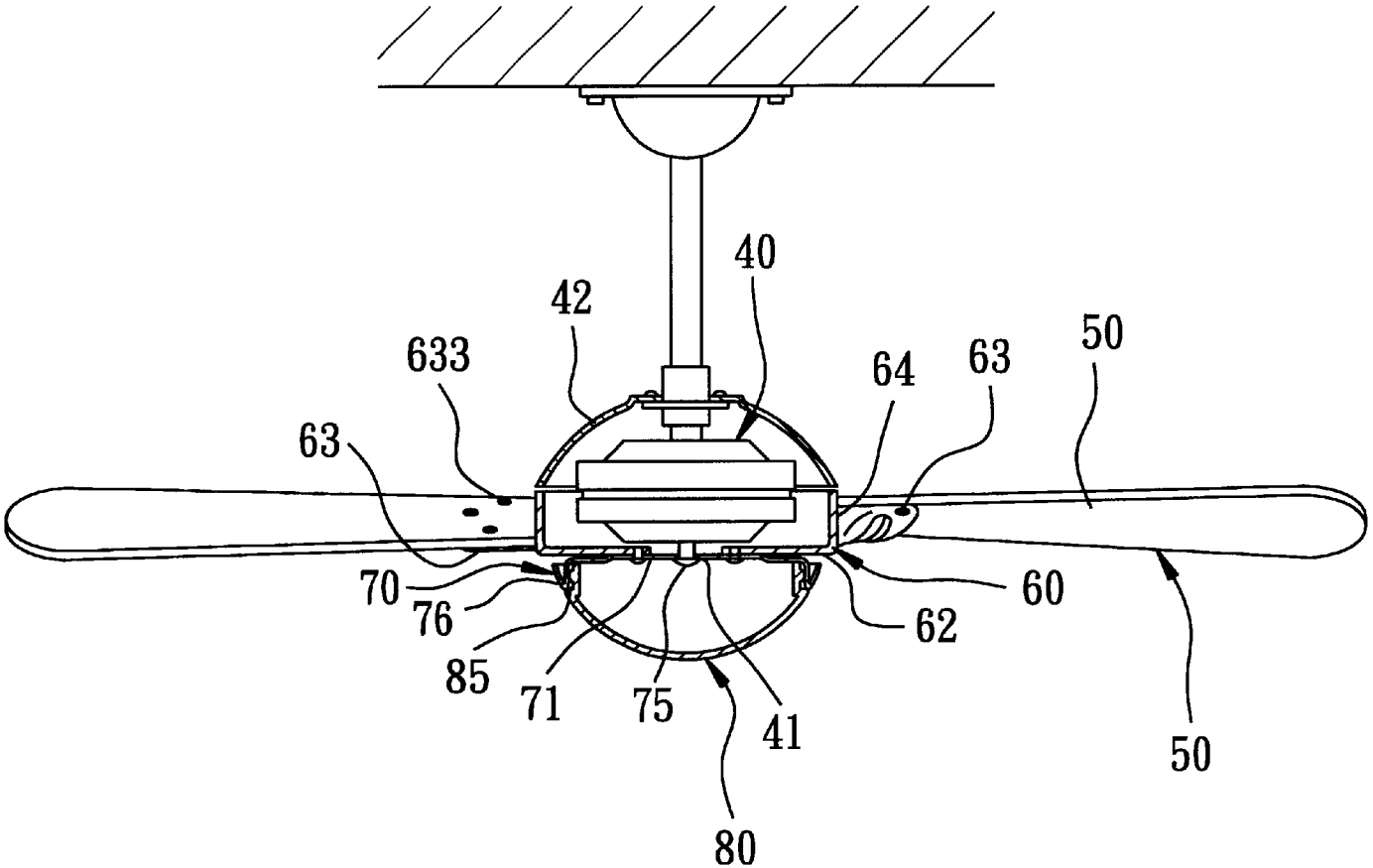
FIG. 4 is a sectional view of the preferred embodiment.

Referring to FIGS. 2, 3 and 4, the preferred embodiment of the ceiling fan according to the present invention is shown to comprise a motor 40, an upper cover 42, a casing body 60, a plurality of fan blades 50, a lamp seat 70, and a lampshade 80.

The motor 40 includes a stator 44 and a rotor 43 surrounding concentrically the stator 44. The stator 44 has first upper and lower end portions which are disposed opposite to each other in an upright direction. The rotor 43 has annular second upper and lower end portions 431,432 which are radially spaced apart from the first upper and lower end portions of the stator 44 respectively and which are rotatable about an axis parallel to the upright direction, and a lateral circumferential portion 433 which is disposed between the second upper and lower end portions 431,432.

The upper cover 42 includes an upper major wall 421 which is mounted on an upper connecting post 441 disposed on the first upper end portion of the stator 44, and an annular skirt portion 422 which extends downwardly from a periphery of the upper major wall 421. The annular skirt portion 422 is spaced radially apart from and shields an upper part of the lateral circumferential portion 433 of the rotor 43 to form an annular first peripheral edge 423 distal to the upper major wall 421.

The casing body 60 includes an annular rotor connecting portion, an annular shielding portion, and a plurality of blade connecting members 63. The annular rotor connecting portion includes a plurality of rotor connecting arms 62 which are arranged angularly along the second lower end portion 432 of the rotor 43. Each rotor connecting arm 62 has a first proximate end which is secured threadedly on the second lower end portion 432 by means of screws 621, and a first distal end opposite to the first proximate end. The annular shielding portion includes a plurality of shielding walls 64. Each shielding wall 64 has a second proximate end which is formed integrally with and which extends radially and outwardly from the first distal end of the rotor connecting arm 62, and a second distal end which extends upwardly from the second proximate end towards the first peripheral edge 423 of the upper cover 42. The second distal end is spaced radially apart from and shields a lower part of the lateral circumferential portion 433 of the rotor 43 so as to cooperate with an adjacent one of the annular shielding wall 64 to constitute the contour of an annular second peripheral edge 641 proximate to and spaced apart from the first peripheral edge 423. Each blade connecting member 63 is formed with and extends radially and outwardly from the respective shielding wall 64 such that the blade connecting members 63 are angularly spaced from each other, and has screw holes 632. The fan blades 50 are secured threadedly and respectively on the blade connecting members 63 via screw fasteners 633 that are inserted into through holes 51 formed in the fan blades 50 and that engage threadedly and respectively the screw holes 632. Preferably, each shielding wall 64 further has a bridge portion 642 which extends outwardly of the second proximate end to engage the second proximate end of the adjacent shielding wall 64 so as to reinforce the engagement among the shielding walls 64.

Figure 5:
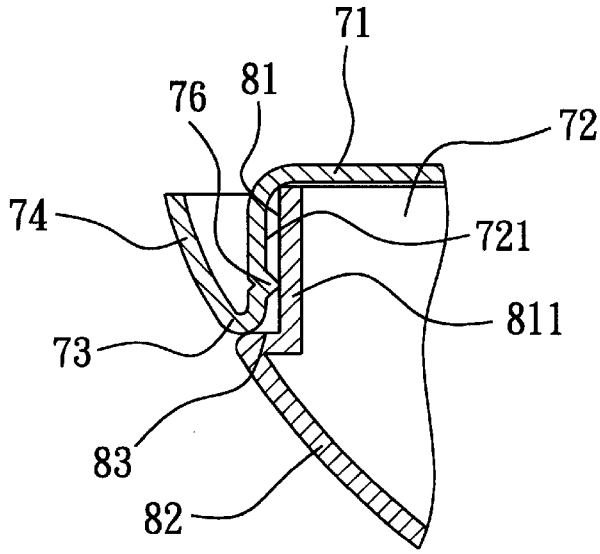
FIGS. 5 and 6 are schematic sectional views showing engagement between a lamp seat and a lampshade of the preferred embodiment.

The lamp seat 70 is made of a metal material, and has an integrally formed structure. With reference to FIG. 5, the lamp seat 70 includes a major wall 71, an annular surrounding wall 721 which extends downwardly from a periphery of the major wall 71, and a ring member 74 which extends upwardly from a lower peripheral edge 73 of the annular surrounding wall 721. The major wall 71 has a lock hole 711 formed therein such that a screw fastener 75 passes through the lock hole 711 and engages threadedly a screw hole 411 in a lower connecting post 41 disposed on the first lower end portion of the stator 44 for securing the lamp seat 70 on the motor 40. A plurality of protrusions 76 are formed on and extend inwardly of the annular surrounding wall 721, and cooperate with the major wall 71 and the annular surrounding wall 721 to confine a receiving space 72.

Figure 6:
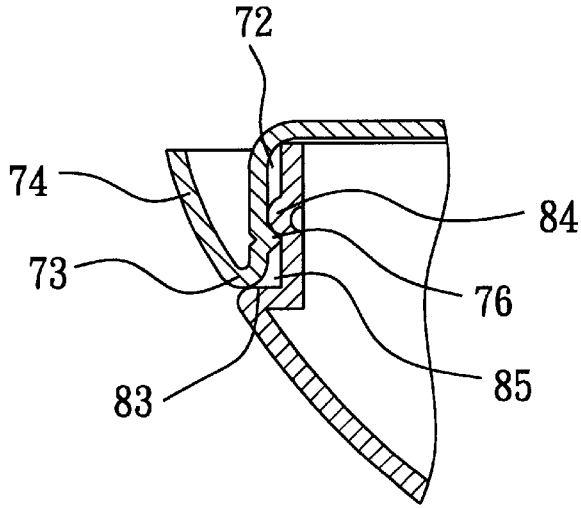

The lampshade 80 is made of a transparent material, and includes a bowl-shaped bottom portion 82 which is provided with an annular engaging flange 81 and an annular retaining flange 83 disposed around the axis. The annular engaging flange 81 has a plurality of elongated protruding members 84 so as to confine with the annular retaining flange 83 a plurality of elongated grooves 85, each of which has opened and closed ends 841,842 and converges from the opened end 841 toward the closed end 842. As shown in FIGS. 5 and 6, when the lampshade 80 is brought to engage the lamp seat 70, each area 811 on the annular engaging flange 81 between two adjacent elongated protruding members 84 is aligned with the respective protrusion 76 such that the annular engaging flange 81 is pressed in the receiving space 72 until the lower peripheral edge 73 abuts against the annular retaining flange 83. Then, the lampshade 80 is rotated about the axis such that each protrusion 76 enters the respective elongated groove 85 from the opened end 841 toward the closed end 842 to be stopped therein. A lamp receiving space is defined by the lampshade 80 and the lamp seat 70 for receiving a lamp (not shown).

As illustrated, during assembly, the rotor connecting arms 62 are secured threadedly on the second lower end portion 432 of the rotor 43 by means of the screws 621. Then, each fan blade 50 is secured threadedly to the respective blade connecting arm 63, thereby simplifying the assembling process. The rotor connecting arms 62 and the shielding walls 64 cooperate with the upper cover 42 for shielding the motor 40.

In addition, the lamp seat 70 and the lampshade 80 are mounted under the motor 40 for receiving a lamp and to shield the screw fasteners 62,75.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A ceiling fan comprising:

a motor including a stator with first upper and lower end portions opposite to each other in an upright direction, and a rotor with annular second upper and lower end portions surrounding concentrically and radially spaced apart from said first upper and lower end portions of said stator respectively and rotatable about an axis parallel to the upright direction, and a lateral circumferential portion disposed between said second upper and lower end portions;

an upper cover including an upper major wall mounted on said first upper end portion and having a periphery, and an annular skirt portion extending downwardly from said periphery and spaced radially apart from and shielding an upper part of said lateral circumferential portion to form an annular first peripheral edge distal to said periphery;

a casing body including an annular rotor connecting portion secured threadedly on said second lower end portion of said rotor, an annular shielding portion extending outwardly and upwardly from said rotor connecting portion towards said first peripheral edge and spaced radially apart from and shielding a lower part of said lateral circumferential portion to form an annular second peripheral edge proximate to and spaced apart from said first peripheral edge, and a plurality of blade connecting members angularly spaced from each other and extending radially and outwardly from said shielding portion; and a plurality of fan blades secured threadedly on said blade connecting members, respectively.

2. The ceiling fan as claimed in claim 1, wherein said annular rotor connecting portion includes a plurality of rotor connecting arms arranged angularly along said second lower end portion of said rotor, each of said rotor connecting arms having a first proximate end secured threadedly on said second lower end portion, and a first distal end; and said annular shielding portion includes a plurality of shielding walls, each having a second proximate end formed integrally with and extending radially and outwardly from said first distal end, and a second distal end extending upwardly from said second proximate end, and spaced apart from and shielding said lower part of said lateral circumferential portion so as to cooperate with an adjacent one of said shielding walls to constitute contour of said annular second peripheral edge.

3. The ceiling fan as claimed in claim 2, wherein each of said shielding walls further has a bridge portion extending outwardly of said second proximate end to engage said second proximate end of an adjacent one of said shielding walls.

4. The ceiling fan as claimed in claim 2, further comprising a lamp seat including a major wall secured threadedly on said first lower end portion of said stator, and an annular surrounding wall extending downwardly from a periphery of said major wall, and a lampshade including a bowl-shaped bottom portion which has an annular engaging flange that is disposed around the axis and that engages said annular surrounding wall of said lamp seat to confine a lamp receiving space with said lamp seat.

5. The ceiling fan as claimed in claim 4, further comprising an annular groove disposed in and along said annular engaging flange and having opened and closed ends such that said annular groove converges from said opened end toward said closed end, and a protrusion disposed on said annular surrounding wall and engaging and sliding along said annular groove from said opened end toward said closed end to be stopped in said annular groove so as to engage said annular engaging flange.

* * * * *